United States Patent [19]

Bellen et al.

[11] 3,998,181

[45] Dec. 21, 1976

[54] APPARATUS FOR SCRAPING METAL COATING ON HOT-COATED METAL STRIPS

[75] Inventors: Franz-Josef Bellen, Dinslaken; Alfons Nikoleizig, Oberhausen-Holten; Friedrich Meuters, Monchengladbach, all of Germany

[73] Assignee: Aggust Thyssen-Hutte AG, Duisburg, Germany

[22] Filed: Sept. 5, 1974

[21] Appl. No.: 503,466

[30] Foreign Application Priority Data

Sept. 7, 1973 Germany ..... 2345157

[52] U.S. Cl. ..... 118/8; 118/63; 118/423; 250/360

[51] Int. Cl.[2] ..... B05C 11/06

[58] Field of Search ..... 118/4, 5, 6, 7, 8, 9, 118/63; 73/37.7; 250/358–360, 272; 427/9, 10, 348, 349

[56] References Cited

UNITED STATES PATENTS

| | | | |
|---|---|---|---|
| 2,661,714 | 12/1953 | Greenwood, Jr., et al. | 118/8 |
| 3,190,261 | 6/1965 | Ziffer | 118/8 |
| 3,397,672 | 8/1968 | Dykeman et al. | 118/49.5 X |
| 3,400,587 | 9/1968 | Franck | 73/37.6 X |
| 3,515,379 | 6/1970 | Baron et al. | 73/351 X |
| 3,526,204 | 9/1970 | Schnedler et al. | 118/63 X |
| 3,621,259 | 11/1971 | Boissevain | 250/360 |
| 3,667,283 | 6/1972 | Takenaka et al. | 73/37.7 |
| 3,681,118 | 8/1972 | Ohama et al. | 427/349 |
| 3,808,033 | 4/1974 | Mayhew | 427/10 X |

*Primary Examiner*—Morris Kaplan
*Attorney, Agent, or Firm*—Haseltine, Lake & Waters

[57] ABSTRACT

Apparatus for scraping metal coatings of hot-coated metal strips such as when hot-galvanizing a steel strip comprising scraping nozzles located above a metal bath and an X-ray fluorescent measuring device disposed downstream of the nozzles for adjusting the pressure at the nozzles in accordance with the measured thickness of the coating so that a pre-determined coating thickness is obtained. The measuring device is supported in a cooling chamber which allows the measuring device to be brought relatively close to the nozzles and a gaseous cooling medium is blown through further nozzles in the space within the chamber between the strip and the measuring device.

16 Claims, 4 Drawing Figures

APPARATUS FOR SCRAPING METAL COATING ON HOT-COATED METAL STRIPS

FIELD OF THE INVENTION

The invention relates to apparatus for scraping the metal coating on hot-coated metal strips, especially when hot-galvanizing a steel strip. Such apparatus comprises nozzles arranged above a metal bath from which the coated strip is removed and passed between the nozzles, a fluorescent measuring device being arranged downstream of the nozzles to automatically adjust the scraping effect, especially the effect of the gas or vapor pressure at the nozzles by measuring the actual value of the thickness of the coating by means of a control device.

BACKGROUND

Such apparatus is known (Magazine "Bänder, Bleche, Rohre", Volume 12, 1971, No. 10, pages 453 and 454). With such apparatus the scraping effect of the nozzles can be ajusted without the temperature and the layer thickness of the air between the strip and measuring device (which varies constantly as a result of the pulsation of the strip) leading to errors in measurement. A solution to the problem of the action of heat on the measuring device is not given in this publication.

In another known similar device (Nuclear Techniques in the Basic Metal Industries, International Atomic Energy Agency, Vienna, 1973, P. 299–317, especially P. 305, FIG. 5) the scraping effect, inter alia, is also adjusted by regulation of the distance of the scraping nozzles from the strip. Here also errors in measurement as a result of change in temperature and change in the layer thickness of the air between the measuring device and the pulsating band do not occur. In order to protect the measuring devices from excessive heat, they are arranged downstream of a cooling tower i.e. at a position where the metal strip has cooled down. Because of this great distance between the location of measurement and the controllable variable (layer thickness) and the place of adjustment (nozzles) the regulating speed is correspondingly slow.

A similar arrangement is also shown in U.S. Pat. No. 3,499,418.

It has already been attempted to employ devices close to the nozzles, and consequently to the place of adjustment, which can tolerate relatively high heat without being damaged, e.g. a beta-ray reflectometer (German Offenlegungsschrift 1,796,303). However, no satisfactory results have been achieved with such a device because the measurements made by the device were not sufficiently precise. The values measured by such a device are distorted both by the temperature of the air between the measuring device and the strip and by the layer thickness of the air between the strip and the measuring device which can scarcely be controlled and which alters constantly as a result of the pulsation of the strip.

SUMMARY OF THE INVENTION

An object of the invention is to provide a control device in apparatus for coating metal strips with a metal covering which avoids the above disadvantages.

The above and other objects are satisfied according to the invention by positioning an X-ray fluorescent measuring device in direct proximity to the nozzles within a cooled chamber, means being provided to blow a gaseous cooling medium into the intermediary space between the metal strip and the measuring device.

The invention enables the use of an X-ray fluorescent measuring device in close proximity to the scraping nozzles so that the regulating speed is essentially increased and consequently any deviations between the nominal value and catual value of the layer thickness are substantially reduced. Changes in temperature and oscillations in the layer thickness of the gaseous cooling medium, especially air, between the measuring device and strip do not have any adverse effects on the measurement results and consequently on the control.

In order that optimal regulation is attained, the measuring device is arranged as close to the nozzles as the construction of the device allows. In practice, good results are attained when the measuring device is 1 to 5 metres from the nozzles.

The chamber is preferably provided with an inlet for a cooling medium, especially air. The air is fed through the inlet and flows around the measuring device in the chamber so that the measuring device is effectively cooled.

According to one embodiment of the chamber, the chamber is heat protected and the measuring device and the heat-protected chamber have an aperture facing the strip, which aperture is closed by a cover, such as a plastic film, which is pervious to the radiation of the metal coating, especially the K $\alpha$ radiation of zinc.

According to another feature of the invention, the chamber has an aperture facing the strip behind which is a second aperture for the measuring device which is closed by a cover, such as a plastic film, which is pervious to the radiation of the metal coating, especially the K $\alpha$ radiation of zinc.

Nozzles for cooling fluid are preferably mounted outside the chamber between the metal strip and said chamber and produce a cooling screen of a gas, particularly air, in front of the chamber and, especially in front of the aperture. Alternatively, the cooling nozzles can also be mounted inside the chamber in front of the surface of the measuring device facing the metal strip, so that a screen of cooling gas, especially air, is produced in front of this surface, especially in front of the aperture in this surface.

In order to place the measuring device at a specific distance from the strip where its sensitivity is optimal, the chamber facing the strip, preferably at right angles to the plane of the strip, can be moved by means of a motorized drive controlled by a distance detectors arranged above one another are preferably provided to determine the average deviation from a nominal value and the actual value of the optimal distance of the strip from the measuring device in the region of the chamber.

Although it is basically possible to arrange a temperature sensor in the chamber for effecting movement of the chamber together with the measuring device from the strip when the temperature is excessive for the measuring device, for a rapid removal of the measuring device from the strip it is advantageous if the measuring device can be moved, in accordance with a further improvement according to the invention, by means of a drive within the chamber which moves the measuring device away from the strip via a control device when there is a disturbance harmful to the measuring device, e.g. too high a temperature. A drive suitable for this purpose is a piston-cylinder arrangement which may be hydraulic.

In order to further increase the regulating speed of the regulating device, the deviation between nominal and actual values determined by the distance detectors for the optimal distance of the measuring device from the strip can be supplied as a disturbance variable to an electronic evaluation circuit which supplies a signal corrected in consideration of the functional correlation between the sensitivity and the distance of the measuring device from the strip (parabola). If the means to ensure that the device can be moved away from the strip (for the protection of the device against too high temperatures) is omitted, then the device does not need to be removable for this measure in order to attain an end result which is not distorted.

Within the contemplation of the invention, it is possible that a measuring device of the type described can be provided on each side of the metal strip. In this way, the layer thickness of the strip can be precisely controlled, but the cost expenditure is considerable. According to a less expensive feature according to the invention, which is similarly effective for controlling the layer thickness on both sides, at least one scraping nozzle is provided on one side of the metal strip and a distance detector is provided for such scraping nozzle, which detector supplies the distance of the metal strip from the scraping nozzle as a disturbance variable to an evaluation circuit, which reduces the pressure of the scraping nozzle on one strip side should the distance decrease, and raises the pressure of the scraping nozzle on the other side of the strip should there by an increase in the distance whereby the scraping effect of the scraping nozzles remains essentially constant. In such a case, a distance detector for the scraping nozzle can be provided on both sides of the metal strip in order to improve the measurement of the distance. If the metal strip is displaced from its central position during operation this will not have a disadvantageous effect on the layer thickness because the pressure is correspondingly corrected in consideration of the increase in distance on one side and the decrease in distance on the other side, so that the layer thickness directly dependent on the scraping effect of the scraping nozzles remains constant.

The invention is described in greater detail hereafter with reference to the appended drawings schematically representing exemplified embodiments of the invention.

DETAILED DESCRIPTION

Figure 1:
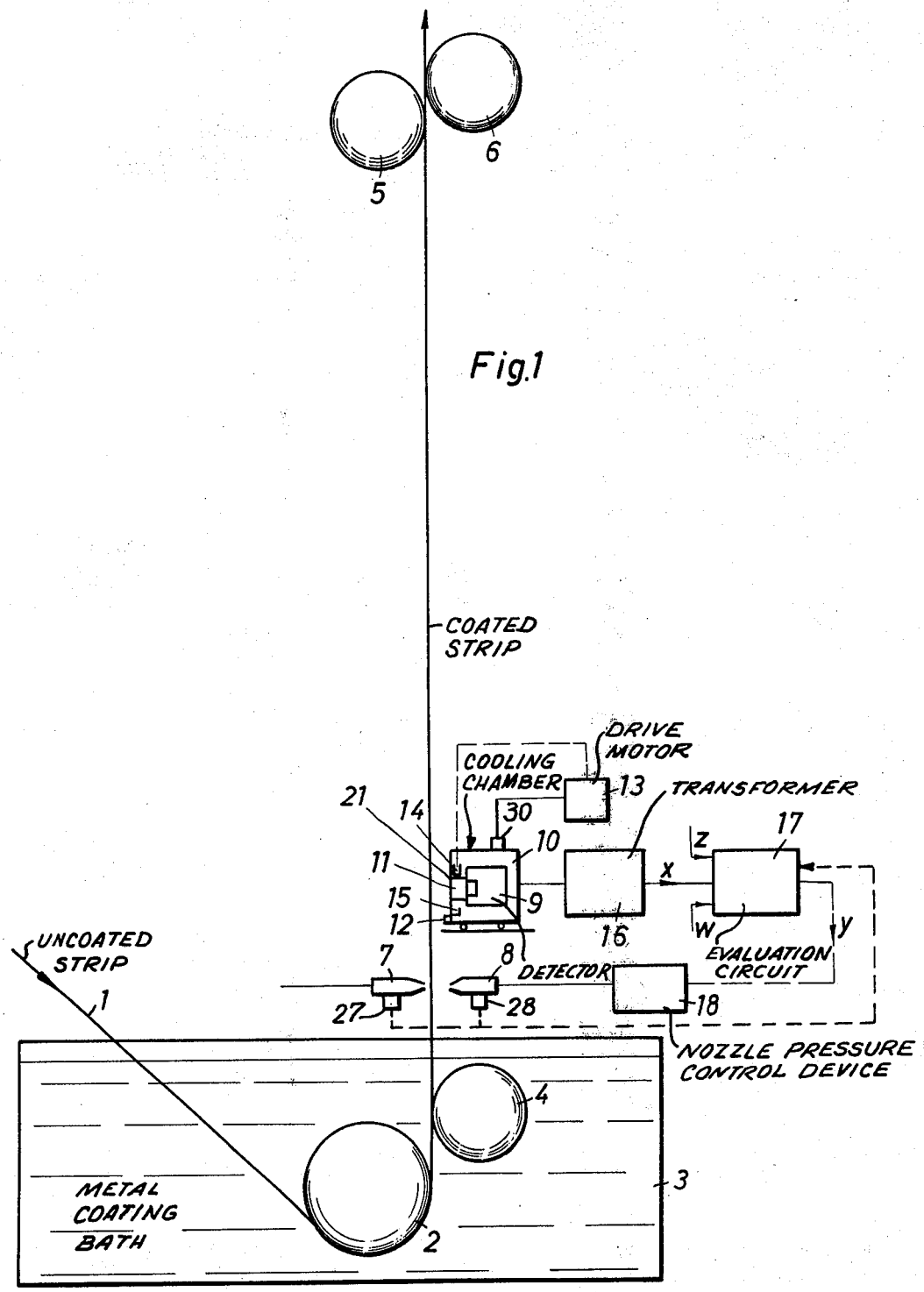
FIG. 1 is a diagramatic elevational view of a first embodiment according to the invention.

In a hot-coating operation, a zinc steel strip 1 is heated and then transported over a deflector roller 2 through a hot metal bath 3. It is removed from the metal bath 3 by means of guid rollers 4, 5, 6. Directly above the hot metal bath 3 are arranged scraping means in the form of nozzles 7, 8 on both sides of the strip 1, each of which direct a narrow, rectilinear fluid flow against the strip 1. The blowing angle is generally somewhat less than 90°, such that one component of the flow is in the direction of the hot metal bath 3. The pressure at the nozzles 7, 8 can be regulated by the means of an adjusting device 18. The construction to this point is entirely convention. Each nozzle 7, 8 is provided with its own distance detector 27, 28 for a reason to be shown later.

A conventional X-ray fluorescent device 9 or **9*a* is arranged in direct proximity above the nozzles 7, 8 in a corresponding heat-protected chamber 10, 10*a* for measuring the thickness of the metal coating on the strip. The measuring device 9 or 9*a* and the heat-protected chamber 10, 10*a* have an aperture 11 which is closed by a plastic foil 21, so that the X-rays emanating from the metal coating can reach the detector 19 of the device 9 or 9*a* without any obstruction. The heat-protected chamber 10, 10*a* is internally cooled, for example, by means of compressed air blown in through a nozzle 12*b* (FIG. 3), so that the measuring device 9*a* is cooled. Additionaly, nozzles 12 are provided to produce a cooling air-screen in front of aperture 11. In the embodiment in FIG. 1 the nozzles 12 are arranged at the outer side of the chamber 10 adjacent strip 1, whereas in the embodiment of FIGS. 2 and 3, corresponding nozzles 12*a* are arranged within the chamber 10*a***.

The chamber 10 can be moved at right angles with respect to the plane of the strip 1. To drive the chamber 10 there is provided a traction motor 13 which is controlled by two distance detectors 14, 15 which are arranged one above another at the side of the chamber 10 facing the strip 1. The control of the traction motor 13 is effected by means of the distance detectors 14, 15, so that the measuring device 9 is guided to a position where it is most sensitive, according to the previously known parabola-shaped function between the sensitivity of the measuring device 9, and its distance from the strip 1.

In the embodiment of FIG. 1 the traction motor 13 is additionally controlled by a temperature sensor 30 arranged at the chamber 10. The temperature sensor 30 takes precedence over the distance detectors 14, 15 in the control. If it determines the existance of a temperature which is too high for the measuring device 9, then it signals the traction motor 13 to move the chamber 10 away from the strip 1.

Figure 2:
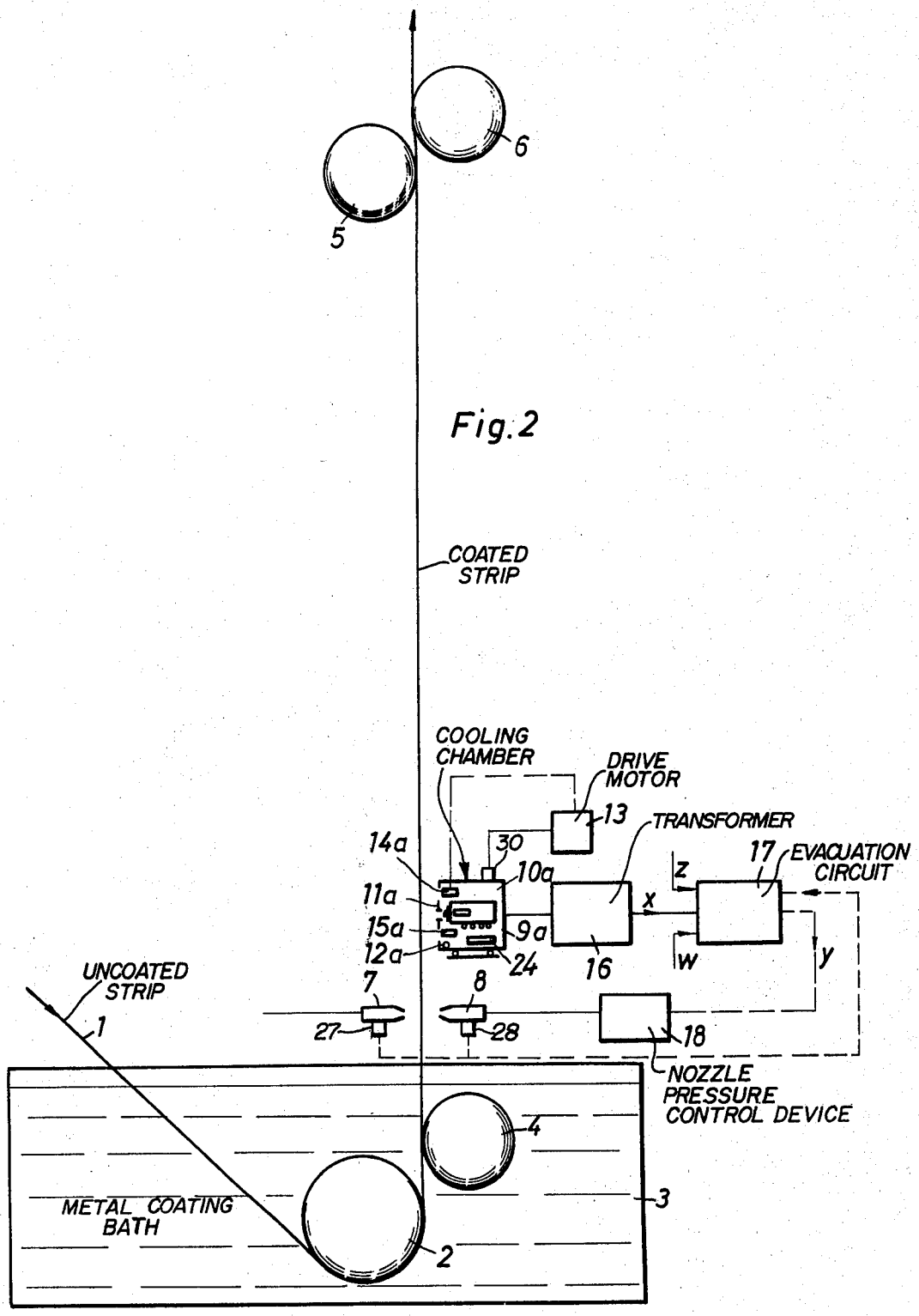
FIG. 2 shows a second embodiment.
Figure 3:
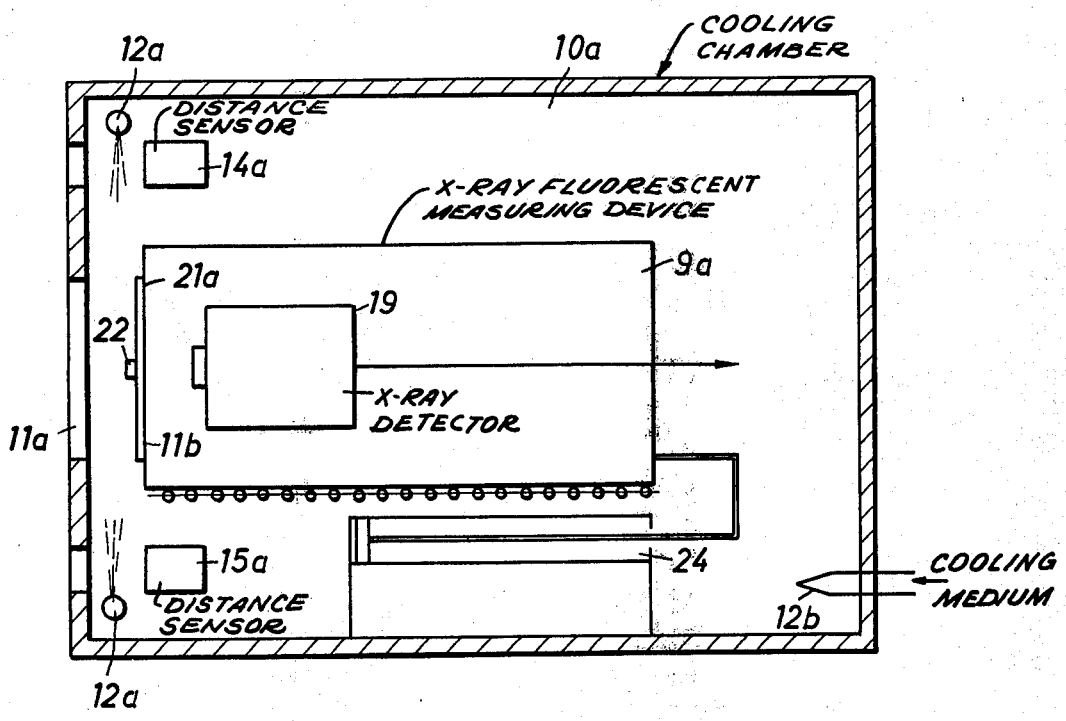
FIG. 3 is a sectional view on enlarged scale of a chamber in the device of FIG. 2.

In the embodiments of FIGS. 2 and 3, the measuring device **9*a* can be moved inside the chamber 10*a* by means of an additional drive 24 in the form or a piston-cylinder arrangement which may be hydraulic, pneumatic or the like. The piston-cylinder arrangement 24 is controlled by a temperature sensor 22 arranged in an aperture 11*b*. If a temperature is sensed by sensor 22 which is too high for the measuring device 9*a*, the measuring device 9*a* is quickly moved away from the strip 1 by means of the piston-cylinder arrangement 24. In this embodiment, the removal can be effected much more quickly than that in FIG. 1 because of the smaller mass to be conveyed in comparison with the entire chamber 10 and because of the drive in the form of the piston-cylinder arrangement 24. Additionally, the drive 24 can be controlled by a pressure measuring device, i.e. a pressure sensor detecting the pressure at the nozzles 12*a***.

Figure 4:
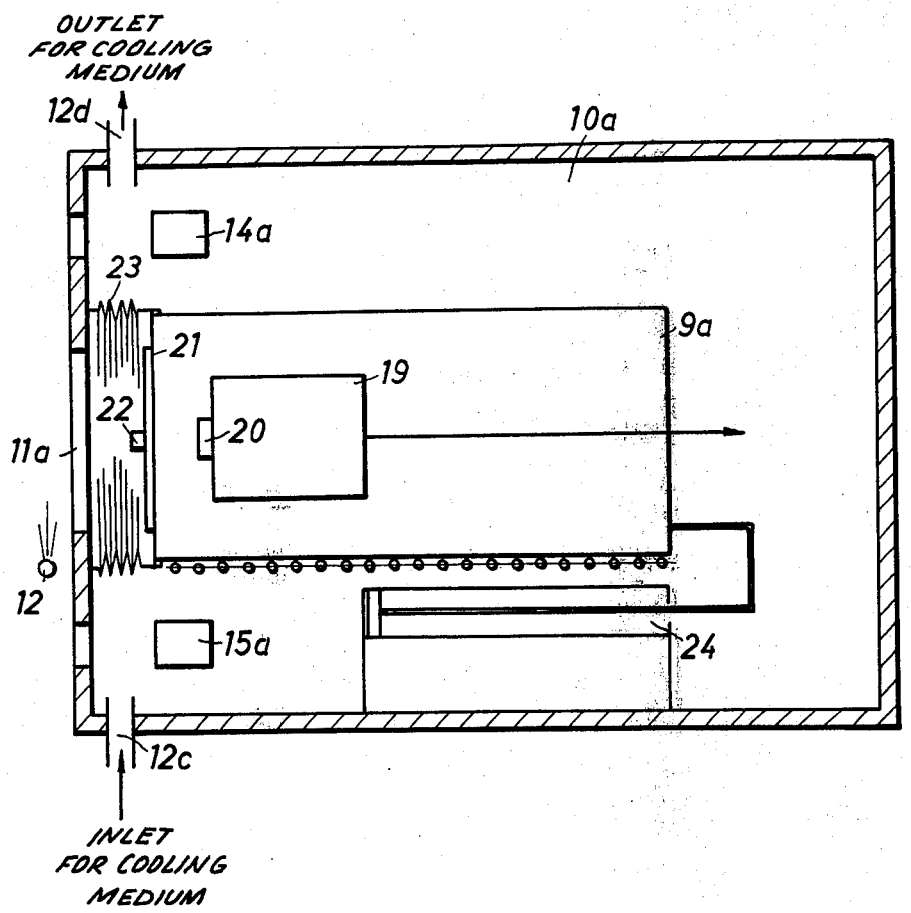
FIG. 4 shows a modified chamber.

In the embodiment of FIG. 4, the X-ray path is screened off by a tube 23. The air nozzle 12 producing the cooling air screen is arranged outside the chamber. The tube 23 enables free travel of the cooling medium within chamber **10*a* without any adverse effect on the measurement. The cooling medium is expediently supplied via inlet 12*c* and removed via outlet 12*d***. Water can be used as the cooling medium.

As is conventional, the measuring device 9 or 9*a* supplies the actual value of the layer thickness as a controllable variable *x* to a conventional evaluation circuit 17 via a transformer 16. The electronic evaluation circuit 17 moreover receives a value of the nominal thickness as a control variable w and it receives from the distance detectors 14, 15 the actual value of the distance of the measuring device 9 from the strip 1 as a disturbance variable *z*. The evaluation circuit 17 sends a control signal, i.e. a so-called regulating variable y, to a device 18 for controlling the pressure at the nozzles 7, 8 as a function of these values. If a layer thickness which exceeds the nominal value is ascertained, then the pressure in the scraping nozzles 7, 8 is raised, whereas if a too small layer thickness is ascertained, the pressure at the scraping nozzles is reduced.

Additionally, the pressure of the scraping nozzles 7, 8 is controlled as a function of the distance of the metal strip 1 from the distance detectors 27, 28 as ascertained by said distance detectors. The distance detectors 27, 28 supply their measurement signals as disturbance variables to the evaluation circuit 17, which controls the regulating device 18 as a function of the ascertained distances so that the pressure of the scraping nozzles 7, 8 are indivually and oppositely adjusted when the metal strip is not in a central position, i.e. the pressure of the nozzle, which is closer to the metal strip 1, is decreased, while the pressure of the other nozzle, whose distance from the metal strip has increased, is raised so that as a result the scraping effect of the nozzles remains constant in spite of varying distance of the metal strip from them.

What is claimed is:

1. In apparatus for scraping metal coatings of hot-coated metal strips, wherein an uncoated strip is passed through a metal coating bath and the thus coated strip is advanced upwardly and passed between scraping nozzles on opposite sides of the strip and measuring means including an x-ray flourescent-measuring device is disposed downstream of the nozzles for measuring the thickness of the coating to control the scraping effect of the nozzles, an improvement comprising a cooling chamber containing said measuring means and disposed at a location relatively close to said nozzles and spaced from said strip, and means for blowing a gaseous cooling medium into the intermediary space within said chamber, between the metal strip and the measuring means.

2. Apparatus as claimed in claim 1 wherein said cooling chamber has an inlet for the cooling medium.

3. Apparatus as claimed in claim 2 wherein said cooling medium is air.

4. Apparatus as claimed in claim 1 wherein said measuring means and the cooling chamber have an aperture facing the strip, and a cover closing said aperture and previous to K*a* radiation from the metal coating.

5. Apparatus as claimed in claim 1 wherein said cooling chamber has an aperture facing said strip behind which is an aperture provided in the measuring means, a cover isolating said apertures from the remainder of the cooling chamber and previous to K*a* radiation from the metal coating.

6. Apparatus as claimed in claim 4 wherein said blowing means comprises nozzles disposed outside said cooling chamber for blowing a cooling gas in the space between the measuring means and the cooling chamber and in front of the aperture in said cooling chamber.

7. Apparatus as claimed in claim 5 wherein said blowing means comprises nozzles inside the cooling chamber for blowing a cooling gas in front of the measuring means adjacent the aperture therein.

8. Apparatus as claimed in claim 1 comprising means for displacing the cooling chamber relative to the metal strip.

9. Apparatus as claimed in claim 8 comprising distance sensing means associated with said measuring means for sensing the distance to said strip, said means for displacing the chamber comprising a drive motor, said distance sensing means being coupled to said drive motor.

10. Apparatus as claimed in claim 9 wherein said distance sensing means comprises two distance detectors arranged above one another to determine average deviation between a nominal value and the actual value of the distance of the strip from the measuring means.

11. Apparatus as claimed in claim 1 comprising drive means for displacing said measuring means within said cooling chamber in a direction away from said strip.

12. Apparatus as claimed in claim 11 comprising a temperature sensor associated with said chamber and connected to said drive means for displacing the measuring means away from the strip when a temperature exceeding a predetermined maximum is sensed.

13. Apparatus as claimed in claim 11 wherein said drive means comprises a piston-cylinder arrangement.

14. Apparatus as claimed in claim 1 wherein deviation of the distance of the measuring means from the strip from a nominal value to the actual value is conveyed as a disturbance variable to an electronic evaluation circuit which supplies a signal corrected in consideration of the functional correlation between the sensitivity and the distance of the measuring means from the metal strip.

15. Apparatus as claimed in claim 14 wherein at least one scraping nozzle has a distance detector, which provides a signal corresponding to the distance of the metal strip from the scraping nozzle as a further disturbance variable to the evaluation circuit, and a pressure control device connected to the evaluation circuit and to the nozzles to reduce the pressure of the scraping nozzle arranged on one strip side should a reduction in distance occur, and to raise the pressure of the scraping nozzle arranged on the other side should the distance simultaneously increase, so that the scraping effect of the nozzles remains substantially constant.

16. Apparatus as claimed in claim 15 wherein on both sides of the metal strip there is respectively provided one said distance detector assigned to the corresponding scraping nozzle.

* * * * *